US010185283B2

(12) United States Patent
Mitsui

(10) Patent No.: US 10,185,283 B2
(45) Date of Patent: Jan. 22, 2019

(54) IMAGE FORMING APPARATUS

(71) Applicant: CANON KABUSHIKI KAISHA, Tokyo (JP)

(72) Inventor: Yuji Mitsui, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/404,582

(22) Filed: Jan. 12, 2017

(65) Prior Publication Data

US 2017/0205761 A1 Jul. 20, 2017

(30) Foreign Application Priority Data

Jan. 19, 2016 (JP) ..... 2016-007877

(51) Int. Cl.
*G03G 15/00* (2006.01)
*G03G 21/16* (2006.01)

(52) U.S. Cl.
CPC ..... *G03G 21/1633* (2013.01)

(58) Field of Classification Search
CPC ..... G03G 21/1633; G03G 21/1647; G03G 2221/169; G03G 2221/1654
See application file for complete search history.

(56) References Cited

U.S. PATENT DOCUMENTS 7,636,530 B2 12/2009 Kitamura et al.
7,860,431 B2 12/2010 Kitamura et al.
9,141,076 B2 * 9/2015 Yuzawa ..... G03G 21/1633
2007/0077085 A1 4/2007 Kitamura et al.
2012/0012445 A1 * 1/2012 Ohta ..... G03G 21/1633 200/50.12

FOREIGN PATENT DOCUMENTS

JP 11-133690 A 5/1999
JP 11-316523 A 11/1999
JP 2007-122000 A 5/2007

OTHER PUBLICATIONS

Office Action dated Oct. 25, 2018, in Chinese Patent Application No. 201710029760.9.

* cited by examiner

*Primary Examiner* — Walter L Lindsay, Jr.
*Assistant Examiner* — Jessica L Eley
(74) *Attorney, Agent, or Firm* — Venable, LLP

(57) ABSTRACT

A biasing member is configured to provide a pressing member with a biasing force acting to bias the pressing member against a detecting portion before the pressing member receives a reaction force from the detecting portion when an opening/closing member is closed. A support portion receives the reaction force acting on the pressing member from the detecting portion while the opening/closing member is closed, and the pressing member maintains an operation state independently with respect to the detecting portion while the opening/closing member is closed.

14 Claims, 13 Drawing Sheets

Z-Z CROSS SECTION

IMAGE FORMING APPARATUS

BACKGROUND OF THE INVENTION

Field of the Invention

The present invention relates to an image forming apparatus configured to form an image on a recording medium using a developer, and more particularly to an image forming apparatus including a detecting portion for detecting opening/closing of an opening/closing member provided at a main body of the apparatus.

Description of the Related Art

In recent years, an electrophotographic image forming apparatus is provided with a plurality of opening/closing members for exposing the inside of the image forming apparatus so that the user can easily exchange consumable goods and supplies or solve a trouble like a jam. Japanese Patent Application Laid-open No. H11-316523 discloses a technique in which an apparatus main body is provided with a detecting portion configured to turn on/off in response to opening/closing of a cover (opening/closing member), and an alarming device is activated when the cover is opened.

Although Japanese Patent Application Laid-open No. H11-316523 does not disclose a specific operation mechanism for the detecting portion, an apparatus including an operation mechanism that is provided on a main body side thereof and that moves in synchronization with an opening/closing operation of the opening/closing member has been known (see Japanese Patent Application Laid-open No. 2007-122000, FIG. 5).

According to a technique disclosed in Japanese Patent Application Laid-open No. 2007-122000, a configuration in which one micro-switch (detecting portion) is used to detect opening/closing operation of two covers (opening/closing members) is provided. More specifically, the configuration includes a lever holder moved in a first direction by closing operation of a top cover (opening/closing member), a spring for biasing the lever holder in a direction opposite to the first direction, and a lever member provided pivotably at the lever holder. While a side cover is closed, the pivotal movement of the lever member is restricted, and while the top cover and the side cover are closed, the lever member presses the micro-switch, whereby the micro-switch is brought into the detecting state.

However, according to Japanese Patent Application Laid-open No. 2007-122000, while the top cover and the side cover are closed, reaction force from the button of the micro-switch is applied on the side cover through the lever member. This may cause the side cover to have creep deformation or the side cover may be shifted from a desired position while the side cover is closed, so that a gap or a step may form between exterior parts around the side cover and the opening/closing member. This causes the timing for switching on/off the micro-switch to vary in some cases.

The side cover receives the reaction force from the micro-switch, and the reaction force may cause the opening/closing member to open in the timing in which the side cover starts to open despite the intention of the user. In the meantime, the opening/closing member may not be closed as easily as intended by the user because of the reaction force in the timing in which the opening/closing member should be completely closed.

SUMMARY OF THE INVENTION

It is an object of the present invention to provide an image forming apparatus capable of reducing a reaction force applied from a detecting portion upon an opening/closing member while the opening/closing member is closed.

In order to achieve the object, an image forming apparatus according to the present invention, comprises:

an apparatus main body;

an opening/closing member that is opened/closed with respect to the apparatus main body;

a detecting portion for detecting an open/closed state of the opening/closing member;

a pressing member configured to move in synchronization with an opening/closing operation of the opening/closing member and press the detecting portion while the opening/closing member is closed;

a support portion that supports the pressing member; and a biasing member configured to provide the pressing member with a biasing force acting to bias the pressing member against the detecting portion before the pressing member receives a reaction force from the detecting portion when the opening/closing member is closed, wherein the support portion receives the reaction force acting on the pressing member from the detecting portion, while the opening/closing member is closed, and the pressing member maintains an operation state independently with respect to the detecting portion, while the opening/closing member is closed.

In order to further achieve the object, an image forming apparatus according to the present invention comprises:

an apparatus main body;

an opening/closing member that is opened/closed with respect to the apparatus main body;

a detecting portion for detecting an open/closed state of the opening/closing member;

a pressing member configured to move in synchronization with an opening/closing operation of the opening/closing member and press the detecting portion while the opening/closing member is closed;

a rotating shaft configured to pivotably support the pressing member; and a biasing member configured to provide the pressing member with a biasing force acting to bias the pressing member against the detecting portion before the pressing member receives a reaction force from the detecting portion when the opening/closing member is closed, wherein the rotating shaft is provided so that, while the opening/closing member is closed, the reaction force acting on the pressing member from the detecting portion is directed to the rotating shaft.

According to the present invention, while the opening/closing member is closed, reaction force applied on the opening/closing member from a micro-switch can be reduced.

Further features of the present invention will become apparent from the following description of exemplary embodiments with reference to the attached drawings.

DESCRIPTION OF THE EMBODIMENTS

Modes for carrying out the present invention are illustratively explained in detail below on the basis of embodiment with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

First Embodiment

<General Structure of Image Forming Apparatus>

Figure 1:
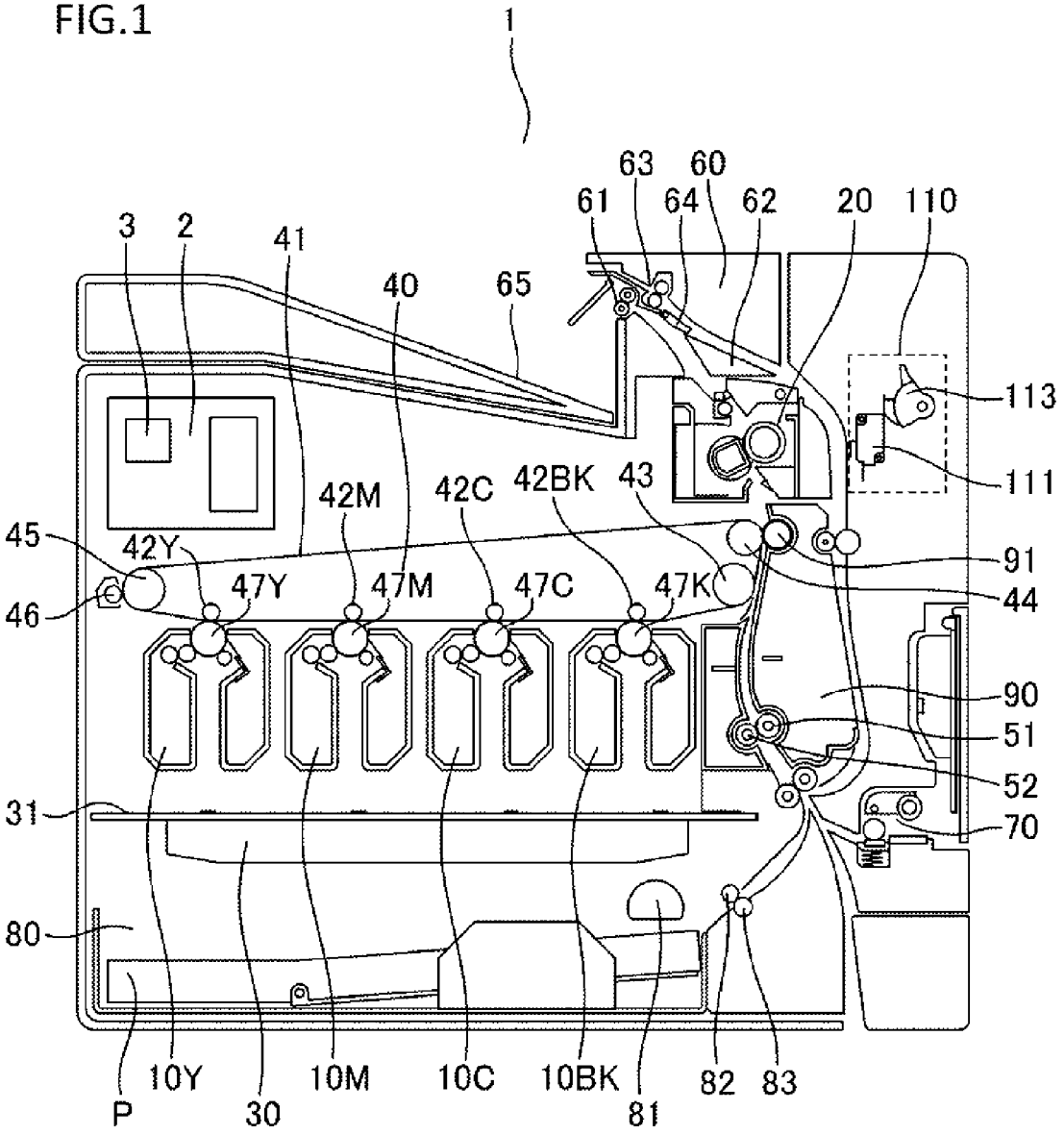
FIG. 1 is a schematic sectional view of a general structure of an image forming apparatus according to a first embodiment of the invention.
Figure 2:
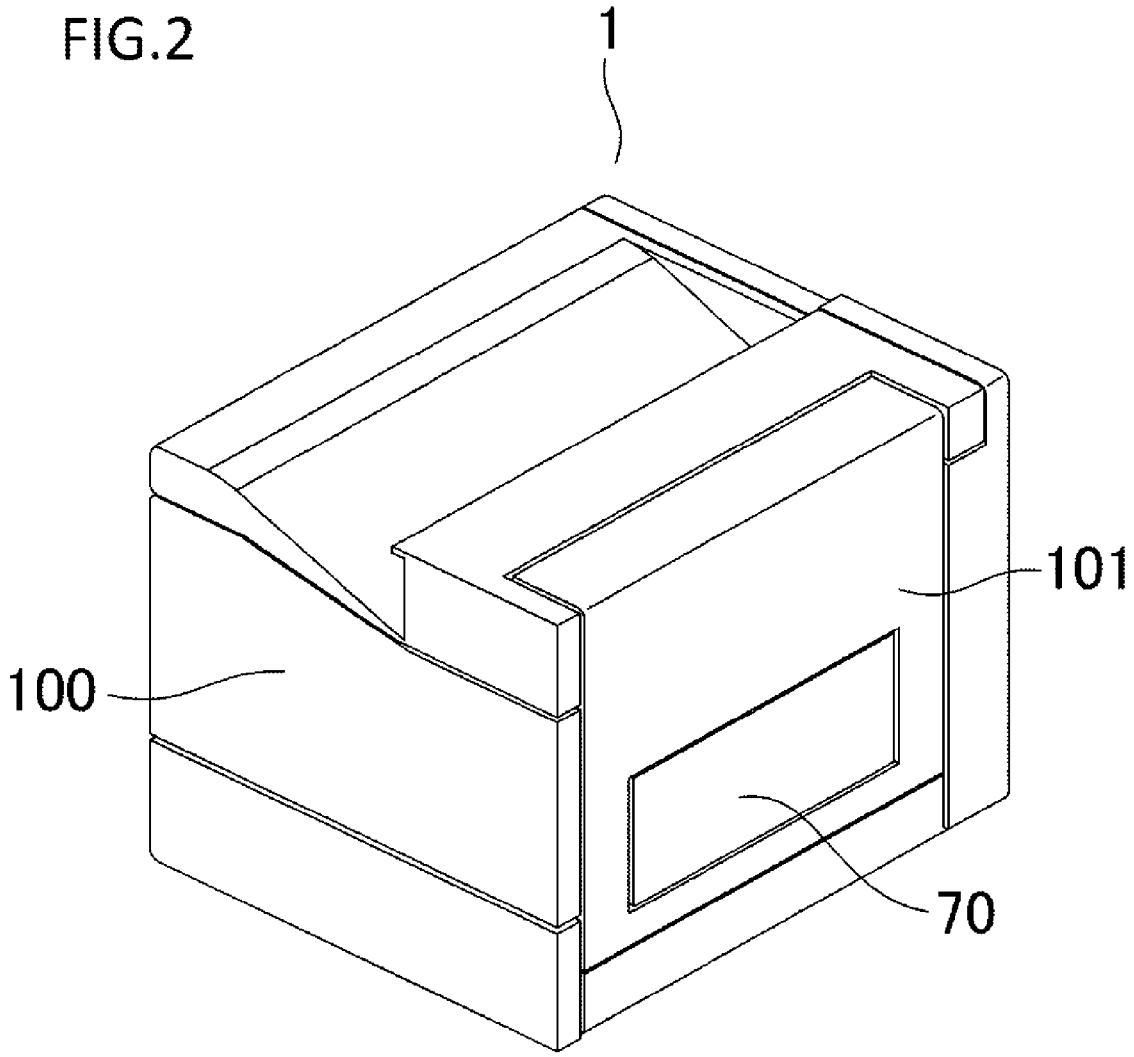
FIG. 2 is a perspective view of an outer appearance of the image forming apparatus according to the first embodiment.

First, a general structure of an image forming apparatus 1 will be described with reference to FIGS. 1 and 2. FIG. 1 is a schematic sectional view of a general structure of the image forming apparatus 1 according to a first embodiment of the invention. FIG. 2 is a perspective view of an outer appearance of the image forming apparatus 1 according to the first embodiment. The image forming apparatus 1 shown in FIG. 1 includes cassette paper feeding portion 80 in the lowermost stage and manual paper feeding portion 70 in the right part. A register roller 51 and a register counter roller 52 configured to register the tip end position of a recording material P for transport are provided above the cassette paper feeding portion 80. A laser scanner unit 30 as exposure portion for forming an electrostatic latent image at photoreceptors 47 (47Y, 47M, 47C, and 47Bk) as an image bearing member is provided above the cassette paper feeding portion 80. A scanner frame 31 is provided immediately above the laser scanner unit 30, and the laser scanner unit 30 is fixed to the scanner frame 31.

Four process cartridges 10 (10Y, 10M, 10C, and 10Bk) are provided above the scanner frame 31. An intermediate transfer unit 40 is provided above the process cartridges 10 to oppose the process cartridges 10. The intermediate transfer unit 40 includes an intermediate transfer belt 41, and primary transfer rollers 42 (42Y, 42M, 42C, and 42Bk), a driving roller 43, a secondary transfer counter roller 44, and a tension roller 45 are provided on the inner side of the intermediate transfer belt 41. Cleaning portion 46 is provided on the outer side of the intermediate transfer belt 41. A secondary transfer unit 90 is provided on the right of the intermediate transfer unit 40. The secondary transfer unit 90 includes a secondary transfer roller 91 provided to oppose the secondary transfer counter roller 44.

A fixing unit 20 is provided above the intermediate transfer unit 40 and the secondary transfer unit 90. A paper discharge unit 60 is provided at the upper left of the fixing unit 20. The paper discharge unit 60 includes a pair of paper discharge rollers 61, a duplex transport portion 62, a pair of reversing rollers 63, and a duplex flapper 64 as branching portion. An image forming controller 2 is provided with a CPU 3, and the image forming controller 2 collectively controls image forming operation carried out by the image forming apparatus 1.

An interlock unit 110 is provided at the upper right of the image forming apparatus 1. The interlock unit 110 has an interlock switch 111 as detecting portion for switching on/off supply of electric power from a power source (not shown) to the laser scanner unit 30. The interlock unit 110 has an action member 113 as a pressing member provided in a position that allows the member to press the interlock switch 111. The action member 113 is provided in the vicinity of the interlock switch 111.

FIG. 2 is a perspective view of an outer appearance of the image forming apparatus 1 according to the first embodiment. As shown in FIG. 2, a front door 100 (additional opening/closing member) is provided on the front side of the image forming apparatus 1, and the front door 100 is attached pivotably at the image forming apparatus 1 so that the door can be opened/closed when the process cartridges 10 (10Y to 10Bk) are exchanged. A right door 101 as an opening/closing member including the manual paper feeding portion 70 is provided in the right part of the image forming apparatus 1. The right door 101 is attached pivotably to the image forming apparatus 1 so that the door can be opened/closed when the fixing unit 20 and the intermediate transfer unit 40 are replaced or a jam is processed.

<Description of Image Forming Operation>

First, printing data including for example a printing instruction and image information is input for example from a host computer (not shown) to the image forming controller 2 (see FIG. 1). The image forming apparatus 1 then starts printing operation, a recording material P is fed from the cassette paper feeding portion 80 to a transfer path by a transport roller 81, a paper feeding transport roller 82, and a paper feeding transport counter roller 83. When an image is formed on the first recording material P, timing for transporting a toner image transferred on the intermediate transfer belt 41 must be synchronized with timing for transporting the recording material P. The first recording material P is therefore stopped once before the secondary transfer roller 91 while being sandwiched between the register roller 51 and the register counter roller 52. The first recording material is then transported to a position where the toner image is transferred onto the recording material P from the intermediate transfer belt 41. In the meantime, the second recording material P and subsequent recording materials are consecutively transported without being stopped.

In synchronization with the feeding operation of the recording material P, toner images in different colors formed by the process cartridges 10 (10Y to 10Bk) are sequentially transferred onto the intermediate transfer belt 41. The toner images (color toner images) transferred upon one another on the intermediate transfer belt 41 move toward the secondary transfer counter roller 44 together with the intermediate transfer belt 41. In the meantime, the recording material P having been stopped is transported as the register roller 51 and the register counter roller 52 are rotated. The recording material P is transported to a nip portion formed by the secondary transfer roller 91 and the intermediate transfer belt 41 in synchronization with the transport of the toner images on the intermediate transfer belt 41. The resultant toner image is transferred on the recording material P at the nip portion by the secondary transfer roller 91 and the intermediate transfer belt 41 (secondary transfer).

The color toner image transferred on the recording material P is heated/pressurized by the fixing unit 20 including a fixing roller and other elements and fixed on the recording material P. The recording material P having the toner image fixed thereon is discharged onto a discharge tray 65 by the pair of discharge rollers 61. In this manner, the normal color image forming operation ends. The image forming apparatus 1 has cleaning portion 46, and toner remaining on the intermediate transfer belt 41 is scraped off by a cleaning member such as a cleaning blade provided in the cleaning portion 46.

<Description of Interlock Switch Unit>

Figure 3:
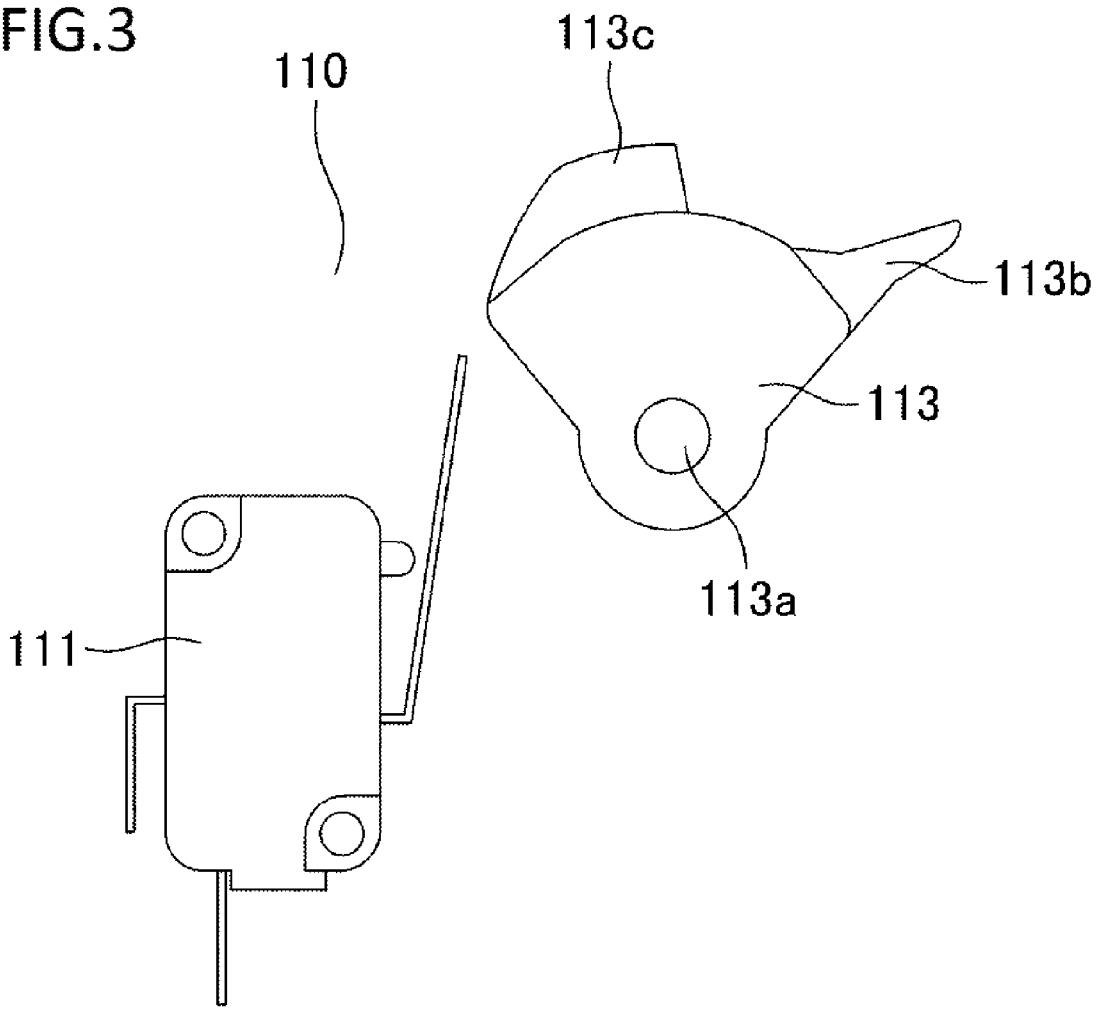
FIG. 3 is a view of an interlock unit according to a reference example while a right door is open.

FIG. 3 is a view of the interlock unit 110 according to the reference example while the right door 101 is open. In FIG. 3, the right door 101 is open. In this state, the interlock switch 111 is off, and supply of electric power (supply of electric power directly by current) from the power source (not shown) to the laser scanner unit 30 is interrupted. The action member 113 is provided at the main body of the image forming apparatus 1 and is supported pivotably around a rotating shaft 113*a* as a support portion with respect to the image forming apparatus 1.

Figure 4:
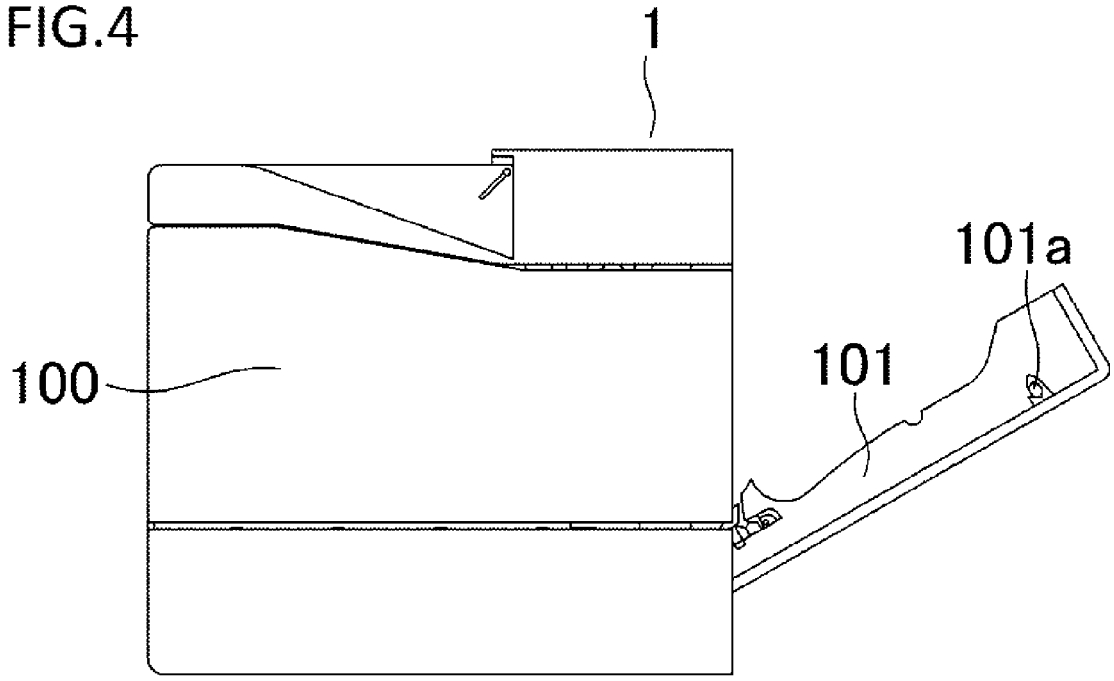
FIG. 4 is a view of an image forming apparatus according to the reference example while the right door is open.
Figure 5:
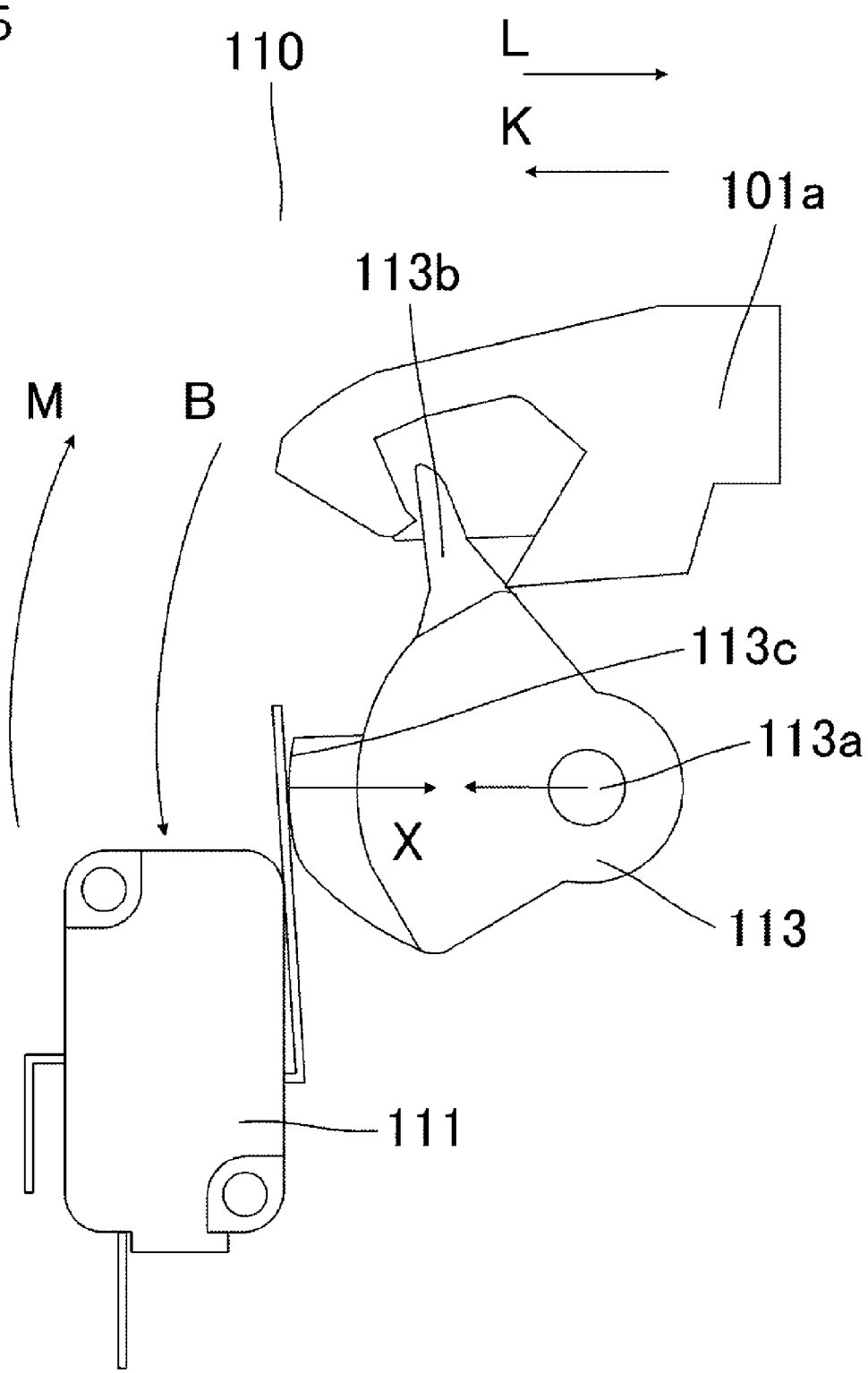
FIG. 5 is a view of the interlock unit according to the reference example while the right door is closed.

FIG. 4 is a view of the image forming apparatus 1 according to the reference example while the right door 101 is open. As shown in FIG. 4, the right door 101 is provided with a right door protrusion 101*a* that has the action member 113 pivot by contacting the action member 113. FIG. 5 is a view of the interlock unit 110 according to the reference example while the right door 101 is closed. When the right door 101 is closed, the right door protrusion 101*a* moves in the direction of the arrow K with respect to the action member 113 and has the action member 113 pivot in the direction of the arrow B by contacting the a contact part 113*b* of the action member 113 as an engagement receiving part. Here, the abutment part 113*c* of the action member 113 forms a circular arc surface, and the center axis of the circular arc of the circular arc surface of the abutment part 113*c* coincides with the rotation center axis of the action member 113 (rotating shaft 113*a*).

The abutment part 113*c* as a pressing part in the action member 113 directly presses the interlock switch 111. The interlock switch 111 has a spring mechanism that is elastically deformed by the pressing force by the action member 113. Therefore, when the abutment part 113*c* of the action member 113 presses the interlock switch 111, the abutment part 113*c* of the action member 113 receives reaction force from the interlock switch 111. The interlock switch 111 has two electric contacts therein and these two electric contacts are released from connection when the switch part in the interlock switch 111 is pressed.

The interlock switch 111 is turned on against the reaction force of the interlock switch 111, so that current is passed from the power source (not shown) to the laser scanner unit 30. At the time, the reaction force from the interlock switch 111 acts in the direction of the arrow X. The direction of the arrow X is a direction toward the rotating shaft 113*a* of the action member 113, and the interlock switch 111 and the action member 113 are arranged so that the reaction force acts upon the rotating shaft 113*a*. Note that the member pressed by the action member 113 does not have to be the interlock switch 111. For example, the member pressed by the action member 113 may be detecting portion for detecting an open state of the right door 101. The member pressed by the action member 113 may be any member that applies reaction force on the action member 113.

In this way, the reaction force from the interlock switch 111 is received by the image forming apparatus 1 that pivotally supports the rotating shaft 113*a* of the action member 113. Then, no angular moment is generated at the action member 113 by the reaction force of the interlock switch 111. More specifically, when the right door 101 is closed, the reaction force from the interlock switch 111 to the action member 113 is directed toward the rotating shaft 113*a*. The line of action of the reaction force from the interlock switch 111 approximately coincides with the line of action of resistance force acting on the action member 113 from the rotating shaft 113*a*. Therefore, any moment of force by the function of the interlock switch 111 is not generated around the rotating shaft 113*a* at the action member 113. The action member 113 can independently operate the interlock switch 111.

Therefore, the action member 113 independently maintains its operation state without moving. The contact part 113*b* of the action member 113 and the right door protrusion 101*a* are in contact but the contact part 113*b* and the right door protrusion 101*a* have no force applied on each other and therefore the right door 101 can be placed in a desired position. When the user opens/closes the right door 101, the reaction force from the interlock switch 111 is less likely to affect the right door 101.

When the right door 101 is opened from the state in FIG. 5, the right door protrusion 101*a* moves in the direction of the arrow L, and the contact part 113*b* of the action member 113 contacts the right door protrusion 101*a*, so that the action member 113 pivots in the direction of the arrow M. Then, the state shown in FIG. 3 is established, and the interlock switch 111 is turned off, so that current from the power source (not shown) to the laser scanner unit 30 is interrupted.

More specifically, the contact part 113*b* receives force from the right door protrusion 101*a* in synchronization with the closing operation of the right door 101, so that the action member 113 moves rotationally around the rotating shaft 113*a*. When the action member 113 rotates by the force from the right door protrusion 101*a*, the abutment part 113*c* provided at the action member 113 presses the interlock switch 111, and supply of electric power from the power source (not shown) to the laser scanner unit 30 is turned off.

As in the foregoing, according to the reference example, while the right door 101 is closed, the rotating shaft 113*a* provided at the main body of the image forming apparatus 1 to support the action member 113 rotatably receives the reaction force acting on the action member 113 from the interlock switch 111. In this way, when the right door 101 is closed, reaction force applied on the right door 101 from the interlock switch 111 can be reduced.

According to the reference example, the abutment part 113*c* of the action member 113 that abuts against the interlock switch 111 forms a circular arc surface, and the center axis of the circular arc of the circular arc surface of the abutment part 113*c* coincides with the rotation center axis of the action member 113. In this way, reaction force from the interlock switch 111 received by the action member 113 is directed toward the rotation center axis of the action member 113.

Also according to the reference example, when an open state of the right door 101 is detected, the interlock switch 111 interrupts supply of electric power from the power source to the laser scanner unit 30. In this way, laser irradiation from the laser scanner unit 30 can be kept from being directed on the user.

Figure 6:
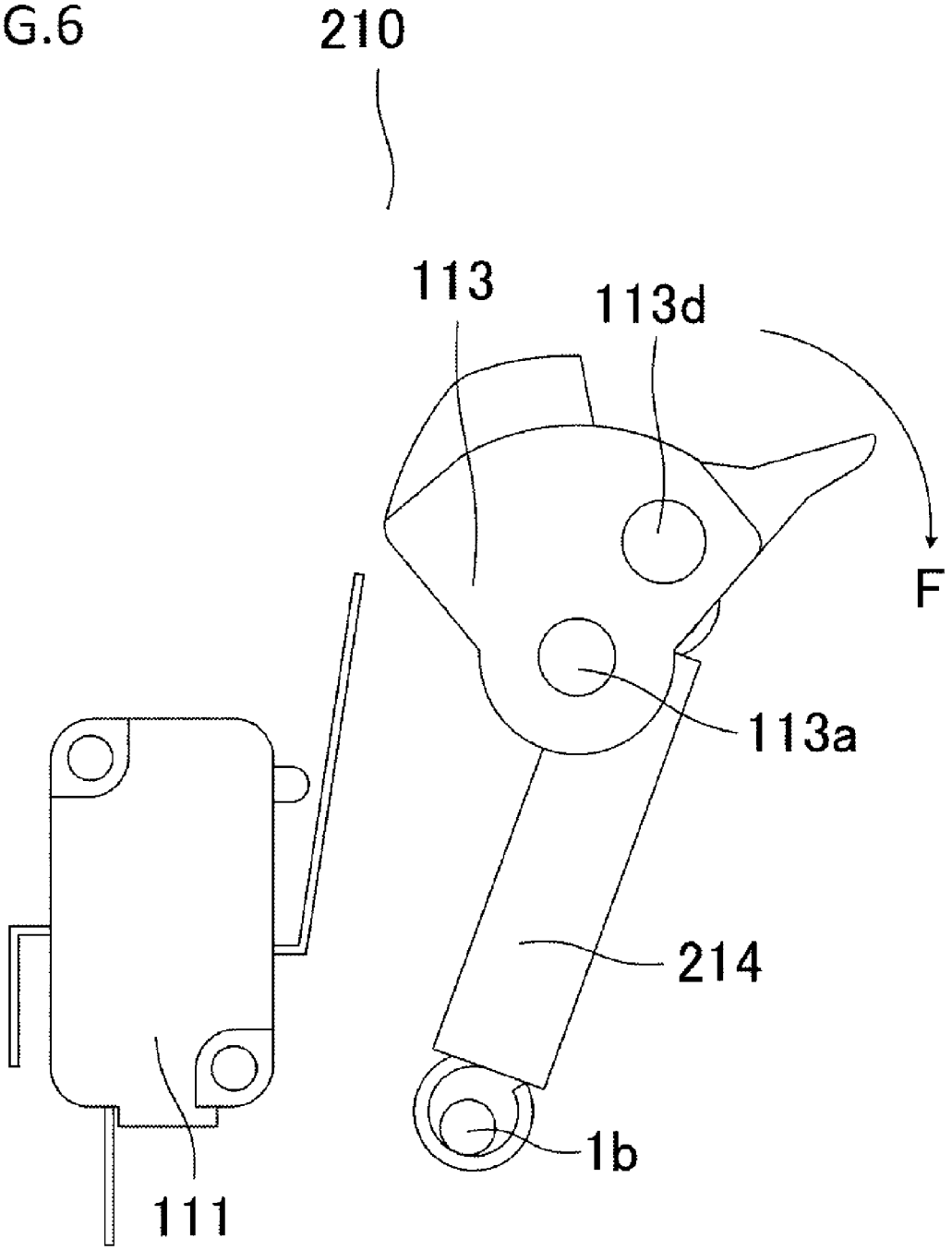
FIG. 6 is a view of an interlock unit according to the first embodiment while a right door is open.

Now, the first embodiment will be described. In the description of the first embodiment, portions having the same functions as those of the reference example will be designated by the same reference characters, and their description will not be provided. FIG. 6 is a view of an interlock unit 210 according to the first embodiment while the right door 101 is open. As shown in FIG. 6, the image forming apparatus 1 is provided with an action member spring 214 as a biasing member that applies an elastic force in a direction in which a spring support portion lb at the main body of the image forming apparatus 1 and a spring support portion 113*d* at the action member 113 move closer to each other.

One end of the action member spring 214 is supported by the spring support portion lb provided at the image forming apparatus 1, and the other end of the action member spring 214 is supported by the spring support portion 113*d* provided at the action member 113. As shown in FIG. 6, while the right door 101 is completely open, the rotating shaft 113*a* and the spring support portion 113*d* of the action member 113 and the spring support portion lb are arranged so that force is applied on the action member 113 in the direction of the arrow F. The action member 113 is positioned by a stopper (not shown) provided at the image forming apparatus 1.

Figure 7:
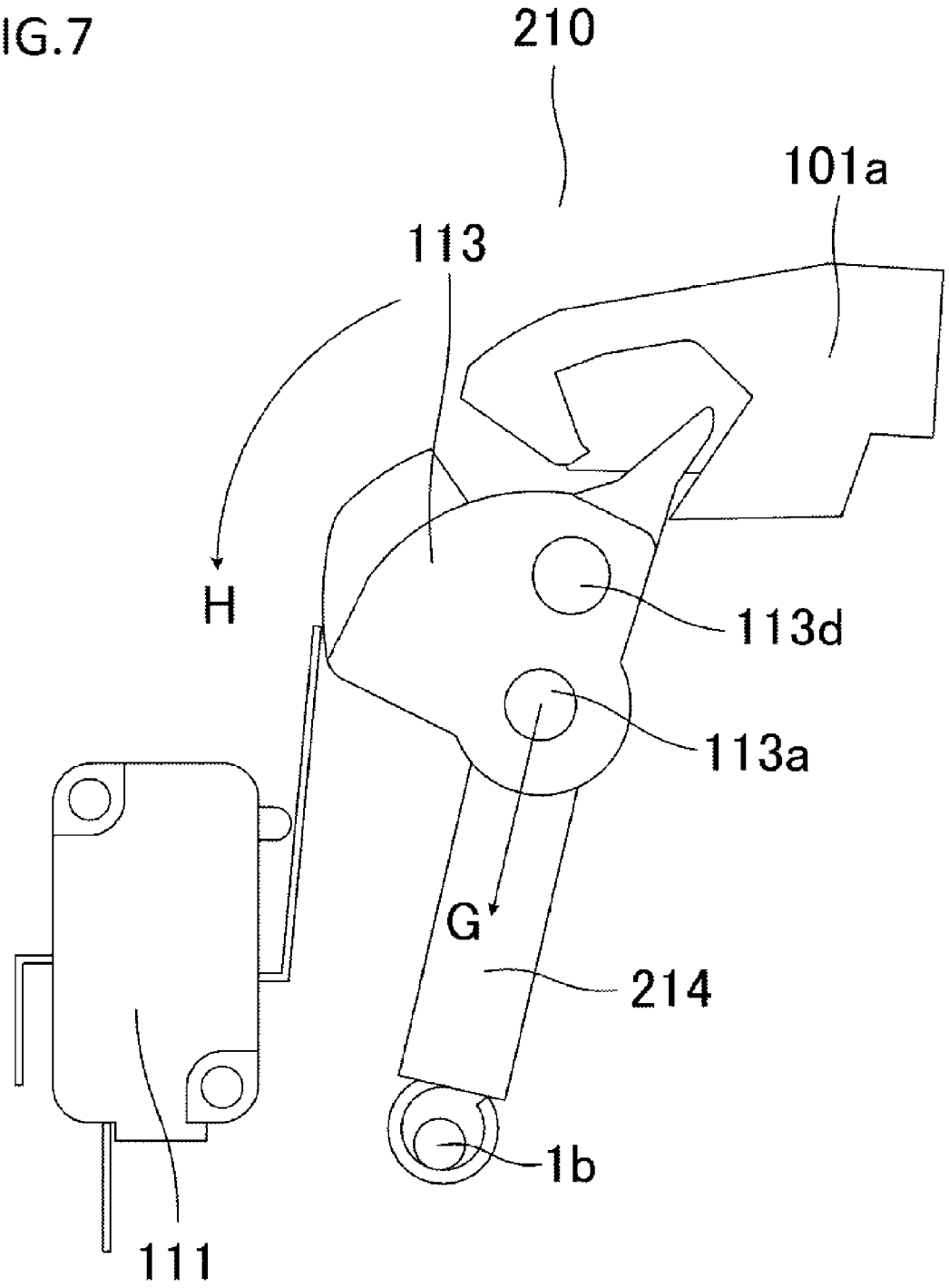
FIG. 7 is a view of the interlock unit according to the first embodiment while the right door is in the process of being closed.

FIG. 7 is a view of an interlock unit 210 according to the first embodiment while the right door 101 is in the process of being closed. As shown in FIG. 7, while the right door 101 is in the process of being closed, the interlock unit according to the embodiment is arranged so that the rotating shaft 113*a* and the spring support portion 113*d* of the action member 113 and the spring support portion lb are aligned. In the state shown in FIG. 7, the direction of force applied from the action member spring 214 on the action member 113 is in the direction of the arrow G, and no rotating force (moment of force) is generated at the action member 113 (a neutral state).

Figure 8:
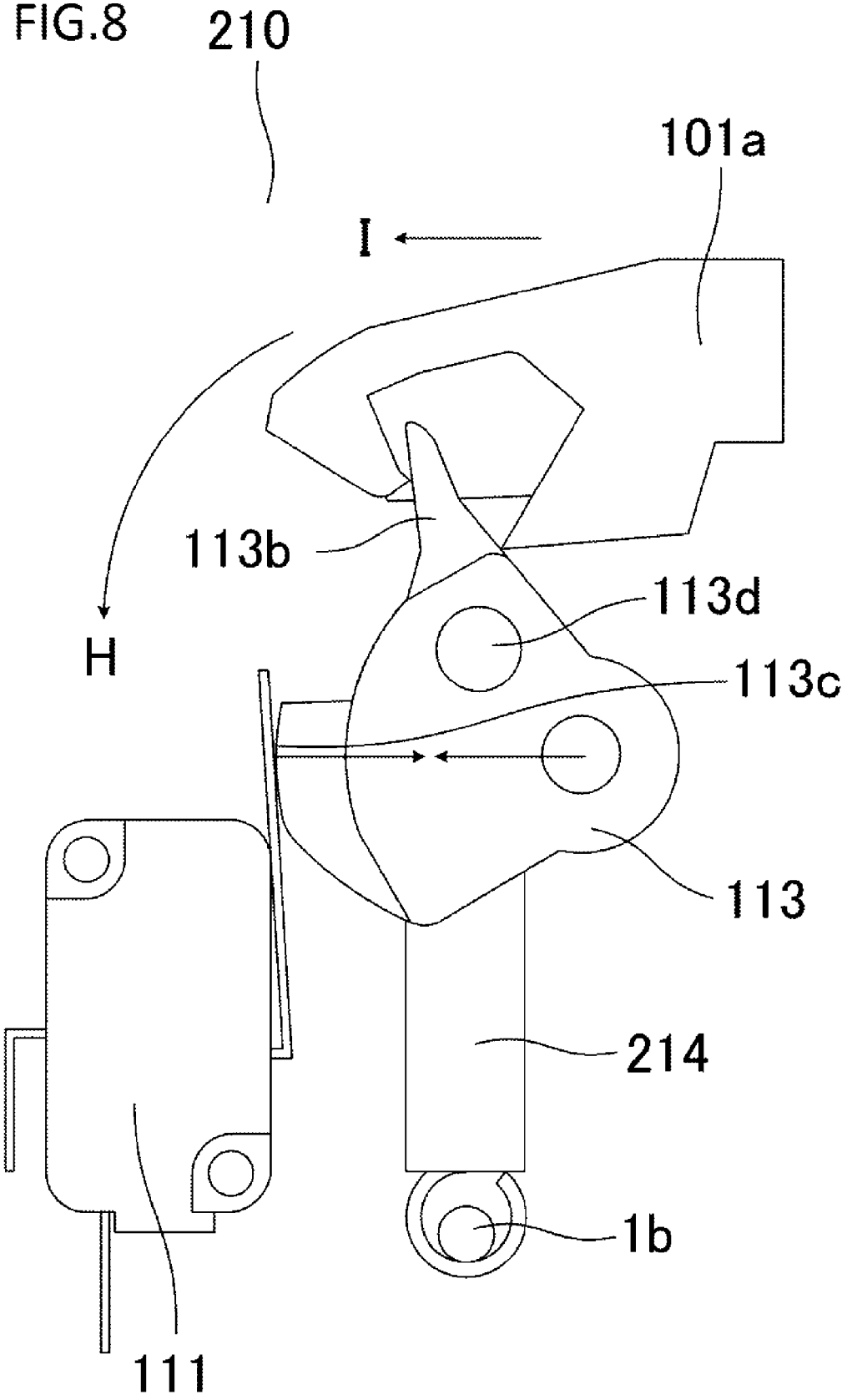
FIG. 8 is a view of the interlock unit according to the first embodiment while the right door is closed.

FIG. 8 is a view of the interlock unit 210 according to the first embodiment while the right door 101 is closed. When the right door 101 is further closed from the state shown in FIG. 7, force applied from the action member spring 214 on the action member 113 causes the action member 113 to pivot in the direction of the arrow H. Then, the contact part 113*b* of the action member 113 presses the right door protrusion 101*a*, and the right door protrusion 101*a* moves together with the action member 113 which moves by the elastic force from the action member spring 214. In this way, the right door 101 is drawn in the direction of the arrow I. More specifically, the action member spring 214 is configured so that the direction of the biasing force applied on the action member 113 changes with respect to the rotating direction of the action member 113 while the right door 101 is in the process of being closed. In other words, until the neutral state (neutral point) is established in which the biasing force applied on the action member 113 by the action member spring 214 acts in neither of the rotation directions when the right door 101 is opened/closed, the biasing force of the action member spring 214 acts to rotate the action member 113 in the reverse direction from the direction of the arrow H. Therefore, the right door 101 is closed by the force against the biasing force of the action member spring 214. After the neutral state is established, the biasing force of the action member spring 214 acts to rotate the action member 113 in the direction of the arrow H. Therefore, the biasing force of the action member spring 214 is added to the force acting to close the right door 101.

More specifically, immediately before the right door 101 is completely closed, moment of force around the rotating shaft 113*a* is generated at the action member 113 by the elastic force of the action member spring 214. The moment is generated in the H direction (a first direction) in which the action member 113 rotates when the abutment part 113*c* presses the interlock switch 111. According to the first embodiment, the spring support portion 1*b*, the spring support portion 113*d*, and the rotating shaft 113*a* are arranged so that the moment acts immediately before the right door 101 is completely closed. The spring support portion 1*b*, the spring support portion 113*d*, and the rotating shaft 113*a* are provided so that the moment acting on the action member 113 is switched from the F direction to act in the H direction immediately before the right door 101 is completely closed.

Then, after the contact part 113*b* presses the right door protrusion 101*a* and the right door protrusion 101*a* starts to move, the abutment part 113*c* pivoting in the direction of the arrow H presses the interlock switch 111. Then, the interlock switch 111 is turned on against reaction force from the interlock switch 111, so that current is passed from the power source (not shown) to the laser scanner unit 30. The rotated action member 113 is positioned by a stopper (not shown) provided at the image forming apparatus 1.

The right door 101 is drawn in the closing direction by the spring force of the action member spring 214, so that the interlock switch is turned on, while a gap or a step between the outer cover of the image forming apparatus 1 and the right door 101 can be eliminated. In this way, the quality of the image forming apparatus can be improved. Furthermore, the right door 101 is drawn by the elastic force of the action member spring 214 immediately before the right door 101 is closed, so that the user may have a clicking feeling, which allows the user to be clearly aware of the closing of the door.

As in the foregoing, according to the first embodiment, the action member spring 214 applies biasing force to the action member 113 across the neutral point with respect to the rotating direction of the action member 113 so that the rotation direction of the action member 113 changes. In this way, immediately before the right door 101 is completely closed, the biasing force by the action member spring 214 acts and the right door 101 is closed.

In addition, the abutment part 113*c* of the action member 113 is brought into a state to press the interlock switch 111 after the biasing state changes to a state in which the biasing force by the action member spring 214 acts to bias the action member 113 in the direction of the arrow H, in other words in the direction in which the right door 101 is closed. Therefore, reaction force from the interlock switch 111 received by the user via the action member 113, the right door protrusion 101*a*, and the right door 101 is canceled or reduced by the biasing force of the action member spring 214. In this way, the user may not feel reaction force from the interlock switch 111 or feel less resistance by the reaction force upon pressing the right door 101.

Similarly to the reference example, the abutment part 113*c* of the action member 113 forms a circular arc surface according to the embodiment, and the center axis of the circular arc of the circular arc surface of the abutment part 113*c* coincides with the rotation center axis of the action member 113. Therefore, as shown in FIG. 8, while the right door 101 is closed, reaction force received from the interlock switch 111 to the action member 113 is directed in the rotation center axis of the action member 113. In this way, while the right door 101 is closed, the reaction force acting on the action member 113 from the interlock switch 111 is received by the rotating shaft 113*a* that rotatably supports the action member 113 provided at the main body of the image forming apparatus 1. Therefore, the reaction force acting on the right door 101 from the interlock switch 111 may be reduced while the right door 101 is closed, and force acting on the right door 101 in the closed state is approximately only the biasing force of the action member spring 214.

Second Embodiment

Now, a second embodiment of the invention will be described. In the following description of the second embodiment, portions having the same functions as those of the reference example and the first embodiment will be designated by the same reference characters and their description will not be provided.

<Description of Interlock Unit 310>

Figure 9:
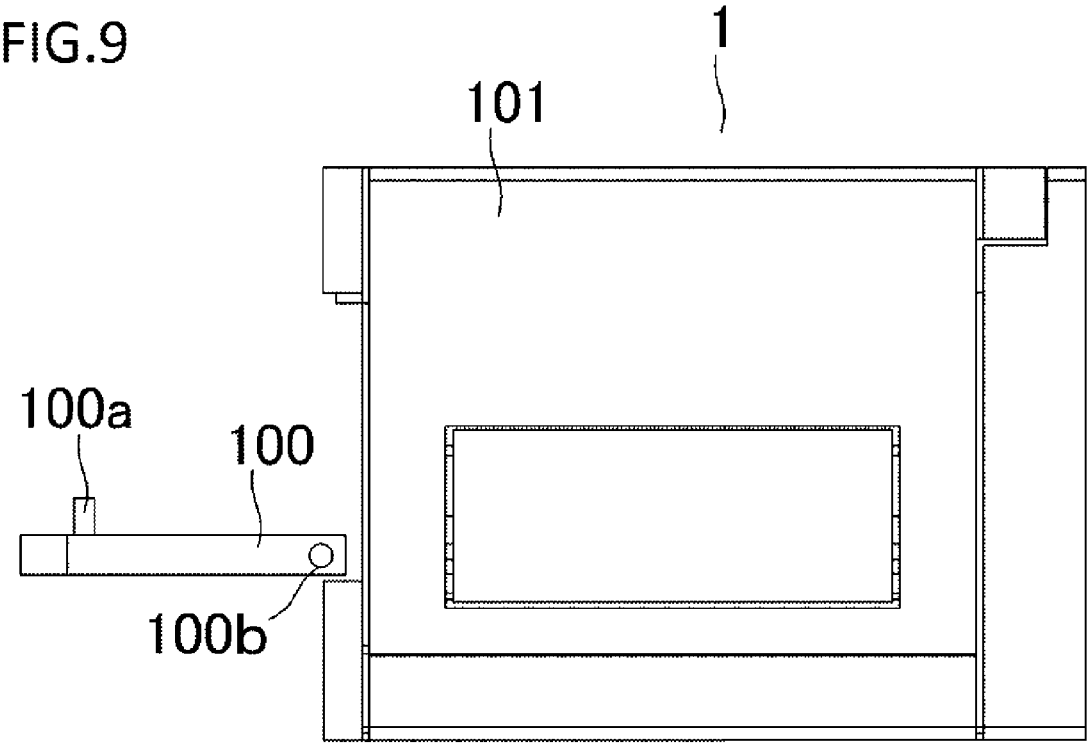
FIG. 9 is a view of an image forming apparatus according to a second embodiment of the invention while a front door is open.

FIG. 9 is a view of the image forming apparatus 1 according to the second embodiment while a front door 100 is open. As shown in FIG. 9, the front door 100 is provided with a front door protrusion 100*a* for moving a second action member 312 (additional pressing member) by contacting the second action member 312.

The second action member 312 is provided at the main body of the image forming apparatus 1 and has a pressing part 312*d* (see FIG. 12), a contact part 312*b* that receives force from the front door protrusion 100*a*, and an abutment part 312*c* that receives force from an abutment part 313*c*. Moreover, the second action member 312 is supported movably between a first position (first state) where the abutment part 312*c* cannot receive force from the abutment part 313*c* and a second position (second state) where the abutment part 312*c* can receive force from the abutment part 313*c*.

The second action member 312 is apart from the first action member 313 in the first state, and the second action member 312 is in proximity to the first action member 313 in the second state. The front door 100 is closed and force is applied from the front door protrusion 100*a* to the contact part 312*b*, so that the second action member 312 moves to the second position.

Figure 10:
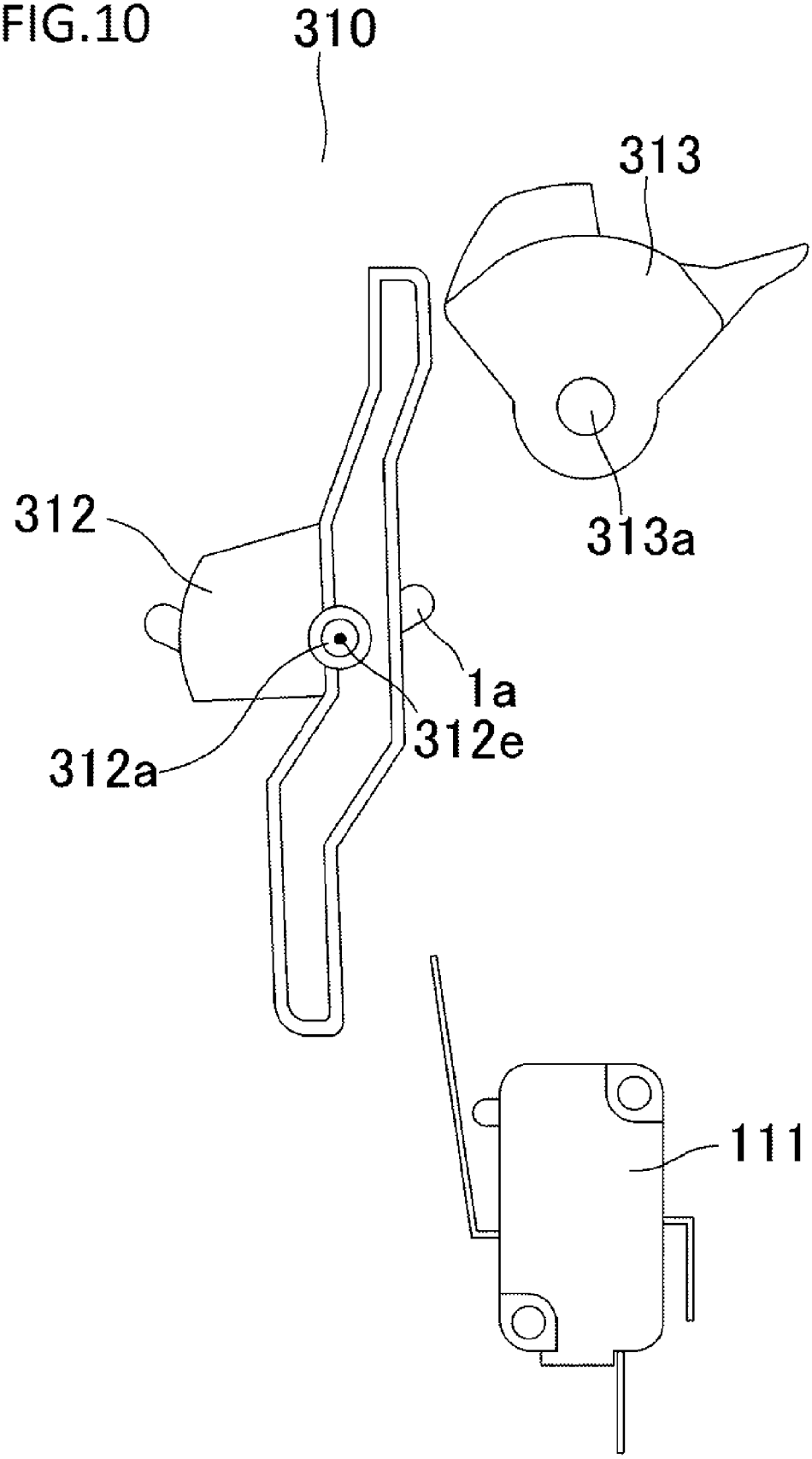
FIG. 10 is a view of the interlock unit while a right door and the front door are open.

FIG. 10 is a view of the interlock unit 310 while the right door 101 and the front door 100 are open. The interlock unit 310 according to the second embodiment is provided with the first action member 313, an interlock switch 111, and the second action member 312 for pressing the interlock switch 111. In FIG. 10, the front door 100 and the right door 101 are both open. In the state, the interlock switch 111 is in an off state, and therefore current from a power source (not shown) to a laser scanner unit 30 is interrupted.

The rotating shaft 312*a* of the second action member 312 is fitted in an oblong hole la provided at the image forming apparatus 1. As the rotating shaft 312*a* is guided in the oblong hole 1*a*, the second action member 312 moves in the lengthwise direction of the oblong hole 1*a*. The rotating shaft 312*a* is fitted in the oblong hole 1*a*, so that the second action member 312 is supported pivotably with respect to the image forming apparatus 1. The first action member 313 is supported pivotably with respect to the image forming apparatus 1 around the rotation center axis 313*a*.

Figure 11A:
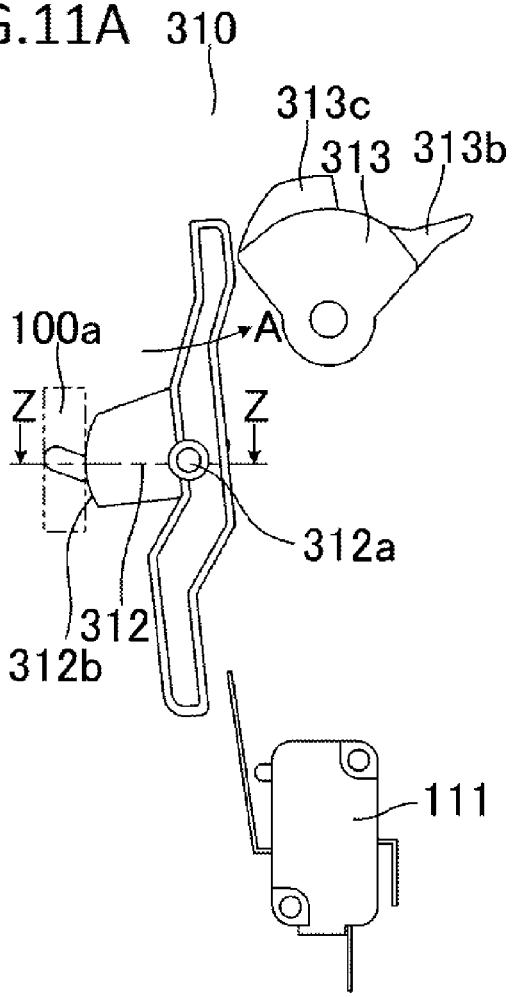
FIGS. 11A and 11B are views of the interlock unit while the right door is open and the front door is closed.
Figure 11B:
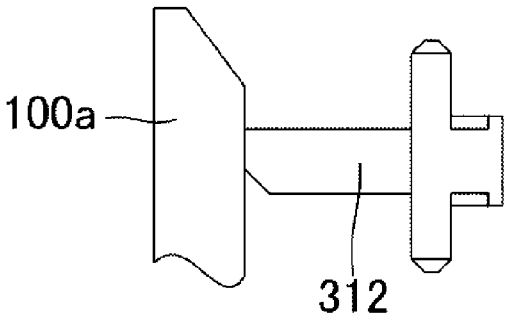

Now, the operation of the interlock unit 310 according to the second embodiment will be described. FIG. 11A and 11B are views of the interlock unit 310 while the right door 101 is open and the front door 100 is closed. The contact part 312*b* of the second action member 312 contacts the front door protrusion 100*a*, so that the second action member 312 moves in the direction of the arrow A. At the time, the second action member 312 is not in contact with the interlock switch 111 and the first action member 313.

Figure 12:
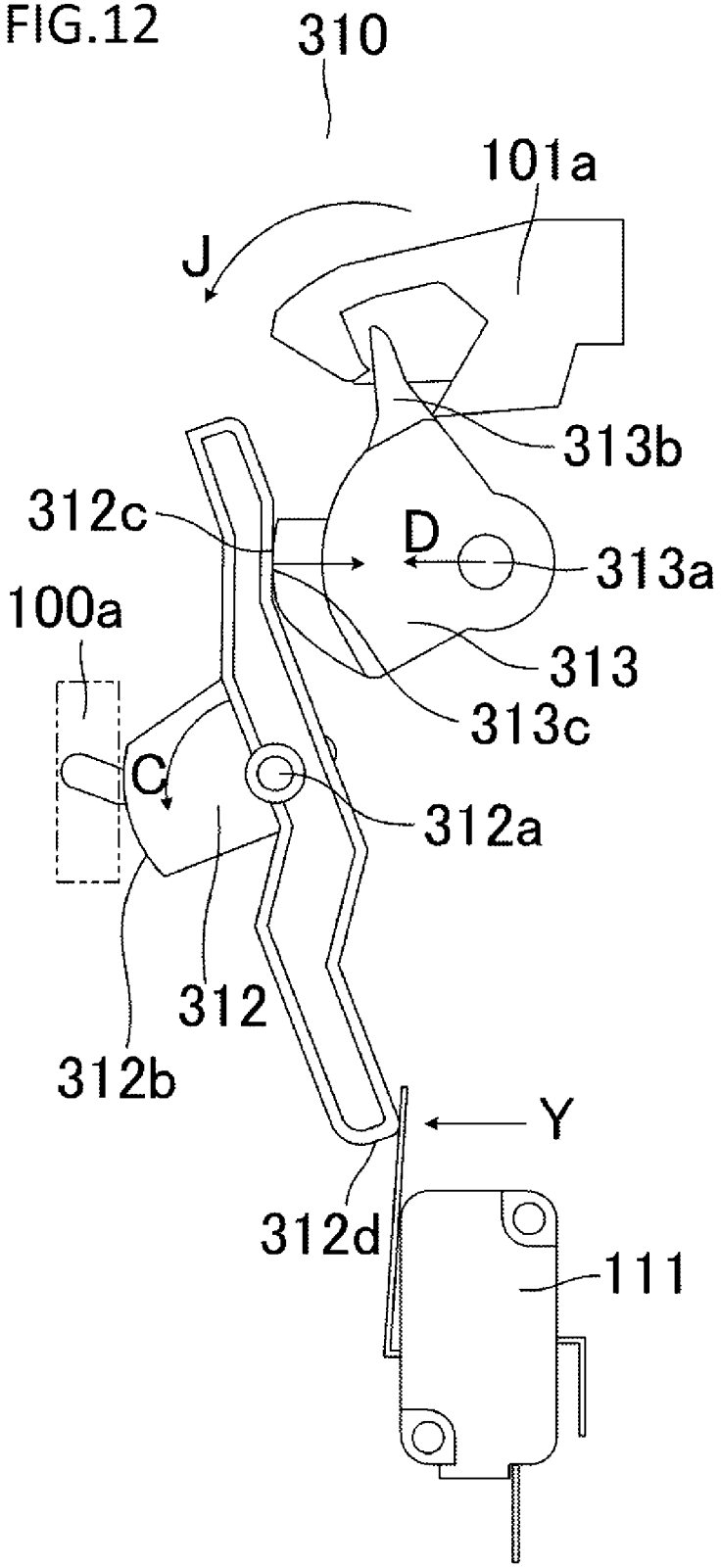
FIG. 12 is a view of the interlock unit while the right door and the front door are closed.

FIG. 12 is a view of the interlock unit 310 while the right door 101 and the front door 100 are closed. When the right door 101 is closed, the right door protrusion 101*a* contacts the contact part 313*b* of the first action member 313, so that the first action member 313 pivots in the direction of the arrow J. Then, the abutment part 313*c* of the first action member 313 presses the abutment part 312*c* as a part of the second action member 312.

The second action member 312 pivots in the direction of the arrow C around the rotating shaft 312*a*, and the pressing part 312*d* of the second action member 312 presses the interlock switch 111. When the interlock switch 111 is turned on against the reaction force of the interlock switch 111, current is passed from the power source (not shown) to the laser scanner unit 30. The contact part 312*b* forms a circular arc surface, and the center axis of the contact part 312*b* forming the circular arc surface approximately coincides with the rotation center axis of the rotating shaft 312*a*. In this way, when the front door protrusion 100*a* is in contact with the contact part 312*b*, reaction force from the front door protrusion 100*a* to the contact part 312*b* is directed to the rotation center axis of the rotating shaft 312*a*. Therefore, no moment of force is generated at the second action member 312 by the reaction force from the front door protrusion 100*a* to the contact part 312*b*.

At the time, the reaction force from the interlock switch 111 to the second action member 312 acts in the direction of the arrow Y and is transmitted to the front door protrusion 100*a* through the second action member 312. However, the direction in which the reaction force transmitted to the front door protrusion 100*a* acts and the opening/closing direction of the front door 100 are 90° shifted in phase. According to the first embodiment, the front door 100 pivots around a rotating shaft 100*b* (see FIG. 9), and the rotating shaft 100*b* and the rotation center axis 312*e* of the rotating shaft 312*a* are orthogonal to each other. In the housing of the image forming apparatus 1, a first surface having the right door 101 thereon and a second surface having the front door 100 thereon are orthogonal to each other, the rotating shaft of the right door is orthogonal to the second surface, and the rotating shaft of the front door 100 is orthogonal to the first surface. In this way, the reaction force from the interlock switch 111 to the second action member 312 does not affect opening/closing operation of the front door 100.

At the same time, the reaction force from the interlock switch 111 to the second action member 312 is also transmitted to the first action member 313 through the second action member 312. The reaction force from the interlock switch 111 to the second action member 312 acts on the first action member 313 in the direction of the arrow D. According to the second embodiment, the shape of the abutment part 312*c* is set and the first action member 313 is provided so that the arrow D is directed to the rotation center axis 313*a* of the first action member 313. In this way, the reaction force from the interlock switch 111 is received by the image forming apparatus 1 that pivotally supports the rotation center axis 313*a* of the first action member 313. No moment of force is generated at the first action member 313 by the reaction force from the interlock switch 111 to the second action member 312. Therefore, the first action member 313 does not move unless any force acts thereon and is independently in a stationary state (the first action member 313 stands by itself with no support).

Figure 13:
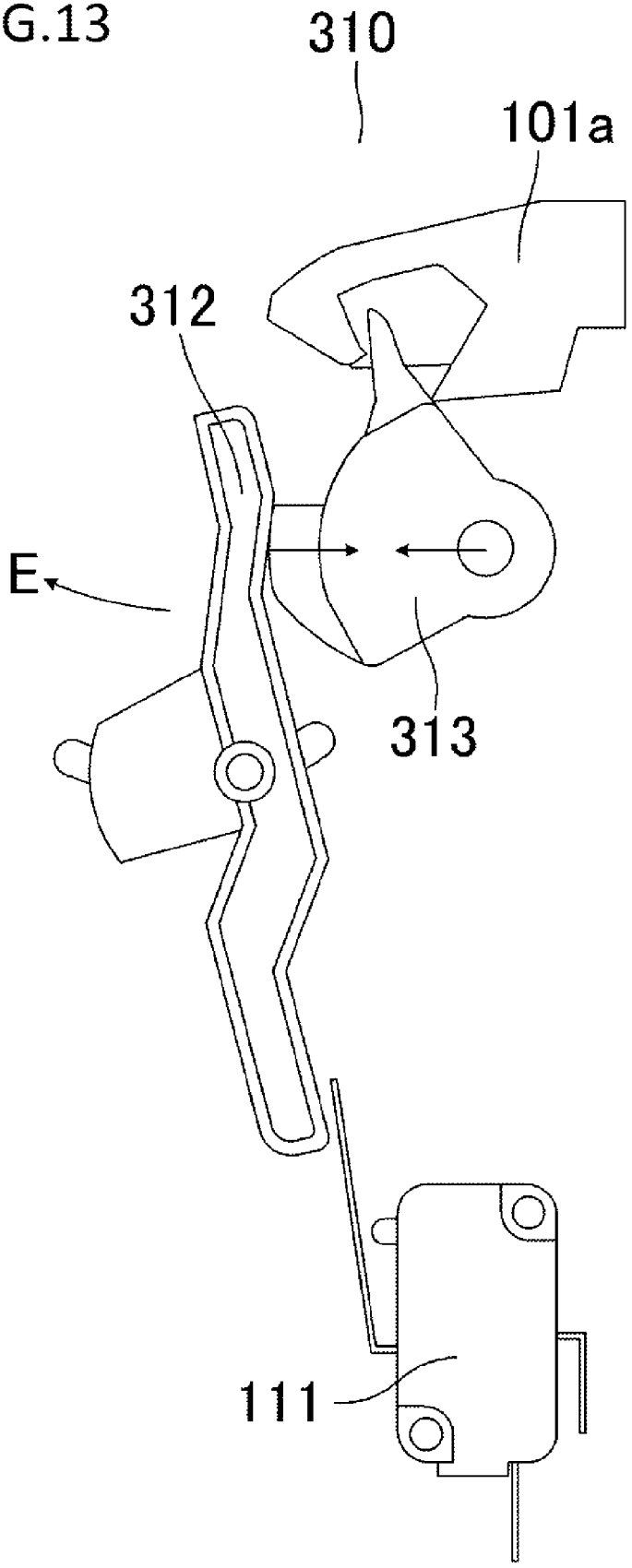
FIG. 13 is a view of an interlock unit while the right door is closed and the front door is open.

FIG. 13 is a view of the interlock unit 310 while the right door 101 is closed and the front door 100 is open. As the front door 100 starts to open, the second action member 312 pivots in the direction of the arrow E by reaction force from the interlock switch 111. Then, when the interlock switch 111 is turned off, current from the power source (not shown) to the laser scanner unit 30 is interrupted. In this timing, the second action member 312 is not in contact with the interlock switch 111.

When the state in which the front door 100 and the right door 101 are both open (see FIG. 10) changes to the state in which the right door 101 is closed and the front door 100 is open (see FIG. 13), reaction force from the interlock switch 111 is not transmitted to the right door 101. Similarly, when the state changes from the state shown in FIG. 13 to the state shown in FIG. 12, reaction force from the interlock switch 111 is not transmitted to the right door 101. Even when the right door 101 is in a closed state, reaction force from the interlock switch 111 is not transmitted to the right door 101 regardless of the open/closed state of the front door 100. In this way, a gap or a step between the outer cover of the image forming apparatus 1 and the right door 101 can be eliminated. Note that when the user opens/closes the right door 101, reaction force from the interlock switch 111 to the second action member 312 has no effect.

As in the foregoing, according to the second embodiment, the front door 100 is provided at a surface adjacent to the surface having the right door 101 thereon, and the second action member 312 that moves in synchronization with the opening/closing operation of the front door 100 is provided. The first action member 313 operates the interlock switch 111 by pressing the interlock switch 111 indirectly through the second action member 312 while the right door 101 and the front door 100 are both closed. In this way, the opening/closing of a plurality of doors can be detected with one switch.

Note that according to the embodiments, the member pressed by the action member 113 or the second action member 312 does not have to be the interlock switch 111. For example, the member pressed by the action member 113 may be a detecting portion for detecting the open state of the right door 101. The member pressed by the action member 113 may be any member that applies a reaction force on the action member 113.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-007877, filed on Jan. 19, 2016, which is hereby incorporated by reference herein in its entirety.

What is claimed is:

1. An image forming apparatus comprising:

an apparatus main body;

an opening/closing member that is opened/closed with respect to the apparatus main body;

a detecting portion for detecting an open/closed state of the opening/closing member;

a pressing member configured to move in synchronization with an opening/closing operation of the opening/closing member and press the detecting portion while the opening/closing member is closed;

a support portion that supports the pressing member; and a biasing member configured to provide the pressing member with a biasing force so that the rotation direction of the pressing member changes, wherein when the opening/closing member is closed with respect to the apparatus main body, a state of the pressing member is changed from a first state, in which the pressing member is biased by the biasing member so that the biasing force acts on the opening/closing member moving in a closing direction via the pressing member from the biasing member, to a second state, in which the pressing member is biased by the biasing member so that the pressing member moves along a moving direction of the opening/closing member, and wherein the support portion receives a reaction force acting on the pressing member from the detecting portion while the opening/closing member is closed.

2. The image forming apparatus according to claim 1, wherein the support portion is a rotating shaft that rotatably supports the pressing member, and the pressing member moves rotationally around the rotating shaft provided at the apparatus main body.

3. The image forming apparatus according to claim 1, wherein a part of the pressing member abutting against the detecting portion forms a circular arc surface, and a center axis of the circular arc surface coincides with a rotation center axis of the pressing member.

4. The image forming apparatus according to claim 1, wherein the pressing member is provided so that the biasing force passes through the neutral point when the opening/closing member is opened/closed.

5. The image forming apparatus according to claim 1, wherein the opening/closing member is provided with an engagement protrusion to engage with the pressing member when the opening/closing member is closed, the pressing member is provided with an engagement receiving part to engage with the engagement protrusion, and a pressing part that presses the detecting portion, and when the opening/closing member is closed, the engagement protrusion engages with the engagement receiving part, so that the pressing member rotates in synchronization with the closing operation of the opening/closing member and the pressing part presses the detecting portion to activate the detecting portion.

6. The image forming apparatus according to claim 1, wherein the detecting portion has a spring mechanism that is elastically deformed by a pressing force from the pressing member.

7. The image forming apparatus according to claim 1, wherein the detecting portion is a switch having an electric contact.

8. The image forming apparatus according to claim 1, further comprising an exposure portion for forming an electrostatic latent image on an image bearing member, wherein the detecting portion interrupts supply of electric power from a power source to the exposure portion upon detecting an open state of the opening/closing member.

9. The image forming apparatus according to claim 1, further comprising an additional opening/closing member provided on a surface adjacent to a surface having the opening/closing member thereon, and an additional pressing member configured to move in synchronization with an opening/closing operation of the additional opening/closing member, wherein the pressing member activates the detecting portion by pressing the detecting portion through the additional pressing member while the opening/closing member and the additional opening/closing member are both closed, and a reaction force acting on the pressing member from the detecting portion through the additional pressing member is directed to the support portion provided in the apparatus main body.

10. The image forming apparatus according to claim 9, wherein while the additional opening/closing member is open and the opening/closing member is closed, the additional pressing member is in a first state in which the additional pressing member is apart from the detecting portion, when the additional opening/closing member is closed from the first state, the additional pressing member moves in synchronization with the closing operation of the additional opening/closing member, so that the pressing member presses the detecting portion through the additional pressing member, while the additional opening/closing member is closed and the opening/closing member is open, the additional pressing member is in a second state in which the additional pressing member is in proximity to the detecting portion, and when the opening/closing member is closed from the second state, the pressing member moves in synchronization with the closing operation of the opening/closing member, so that the pressing member presses the detecting portion through the additional pressing member.

11. The image forming apparatus according to claim 10, wherein the additional pressing member is rotatably supported around a rotating shaft, and the pressing member presses a part of the additional pressing member to cause the additional pressing member to rotate around the rotating shaft, so that another part of the additional pressing member presses the detecting portion to activate the detecting portion, and the rotating shaft of the additional pressing member moves in synchronization with the opening/closing operation of the additional opening/closing member, such that the first state is established while the additional opening/closing member is open and the second state is established while the additional opening/closing member is closed.

12. The image forming apparatus according to claim 9, wherein a first surface having the opening/closing member thereon is orthogonal to a second surface having the additional opening/closing member thereon, a rotating shaft of the opening/closing member is orthogonal to the second surface, and a rotating shaft of the additional opening/closing member is orthogonal to the first surface.

13. An image forming apparatus comprising:

an apparatus main body;

an opening/closing member that is opened/closed with respect to the apparatus main body;

a detecting portion for detecting an open/closed state of the opening/closing member;

a pressing member configured to move in synchronization with an opening/closing operation of the opening/closing member and press the detecting portion while the opening/closing member is closed;

a rotating shaft configured to pivotably support the pressing member; and a biasing member configured to provide the pressing member with a biasing force acting to bias the pressing member against the detecting portion before the pressing member receives a reaction force from the detecting portion when the opening/closing member is closed, wherein the rotating shaft is provided so that, while the opening/closing member is closed, the reaction force acting on the pressing member from the detecting portion is directed to the rotating shaft.

14. An image forming apparatus comprising:

an apparatus main body;

an opening/closing member that is opened/closed with respect to the apparatus main body;

a detecting portion for detecting an open/closed state of the opening/closing member;

a pressing member configured to move in synchronization with an opening/closing operation of the opening/closing member and press the detecting portion while the opening/closing member is closed;

a support portion that supports the pressing member; and a biasing member that crosses a neutral point with respect to a rotation direction of the pressing member to provide the pressing member with a biasing force so that the rotation direction of the pressing member changes, wherein the support portion receives a reaction force acting on the pressing member from the detecting portion while the opening/closing member is closed.

* * * * *